US009945296B2

(12) United States Patent
Tsukahara

(10) Patent No.: US 9,945,296 B2
(45) Date of Patent: Apr. 17, 2018

(54) SIX-STROKE ENGINE AND METHOD OF OPERATING SIX-STROKE ENGINE

(71) Applicant: YAMAHA HATSUDOKI KABUSHIKI KAISHA, Iwata-shi, Shizuoka (JP)

(72) Inventor: Ei Tsukahara, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 94 days.

(21) Appl. No.: 14/902,691

(22) PCT Filed: Jun. 20, 2014

(86) PCT No.: PCT/JP2014/066394
§ 371 (c)(1),
(2) Date: Jan. 4, 2016

(87) PCT Pub. No.: WO2015/005097
PCT Pub. Date: Jan. 15, 2015

(65) Prior Publication Data

US 2016/0169125 A1 Jun. 16, 2016

(30) Foreign Application Priority Data

Jul. 9, 2013 (JP) ..... 2013-143253

(51) Int. Cl.
*F02B 1/04* (2006.01)
*F02D 13/02* (2006.01)
(Continued)

(52) U.S. Cl.
CPC ..... *F02D 13/0261* (2013.01); *F01L 1/047* (2013.01); *F01L 1/08* (2013.01);
(Continued)

(58) Field of Classification Search
CPC .. F02B 75/021; F02B 1/00; F02B 1/04; F02B 3/06; F02F 2001/247
See application file for complete search history.

(56) References Cited

U.S. PATENT DOCUMENTS

2003/0226524 A1 12/2003 Ziabazmi
2004/0123819 A1* 7/2004 Ziabazmi ..... F02B 75/021 123/52.1
(Continued)

FOREIGN PATENT DOCUMENTS

EP 2 808 516 A1 12/2014
EP 2 808 517 A1 12/2014
(Continued)

OTHER PUBLICATIONS

Official Communication issued in International Patent Application No. PCT/JP2014/066394, dated Jul. 29, 2014.

*Primary Examiner* — Jacob Amick
*Assistant Examiner* — Charles Brauch
(74) *Attorney, Agent, or Firm* — Keating and Bennett, LLP

(57) ABSTRACT

A six-stroke engine includes a cylinder, a piston, a cylinder head, a combustion chamber, an intake port, an exhaust port, an intake valve, an exhaust valve, a fuel injector, and an ignition plug. The six-stroke engine includes a valve gear that operates the intake valve and the exhaust valve to execute an intake stroke, a compression stroke with ignition, an expansion stroke with combustion, an exhaust stroke, an expansion stroke without combustion, and a compression stroke without ignition. The valve gear opens, only for a predetermined period of time while the piston is located at top dead center, at least one of the intake valve and the exhaust valve within a period from the exhaust stroke to the intake stroke. A valve overlap state is produced at least once
(Continued)

within the period from the exhaust stroke to the intake stroke.

10 Claims, 16 Drawing Sheets

(51) Int. Cl.

| | |
|---|---|
| ***F01L 1/38*** | (2006.01) |
| ***F02B 75/02*** | (2006.01) |
| ***F01L 1/047*** | (2006.01) |
| ***F01L 1/08*** | (2006.01) |
| *F02F 1/24* | (2006.01) |
| *F02B 3/06* | (2006.01) |
| *F02B 1/00* | (2006.01) |

(52) U.S. Cl.
CPC ..... *F01L 1/38* (2013.01); *F02B 75/021* (2013.01); *F02D 13/02* (2013.01); *F02B 1/00* (2013.01); *F02B 1/04* (2013.01); *F02B 3/06* (2013.01); *F02F 2001/247* (2013.01)

(56) References Cited

U.S. PATENT DOCUMENTS

2009/0018749 A1* 1/2009 Sauer ..... F02D 13/0265 701/103
2010/0313831 A1* 12/2010 Szybist ..... F02B 47/02 123/64

FOREIGN PATENT DOCUMENTS

| | | | |
|---|---|---|---|
| JP | 6-2558 | A | 1/1994 |
| JP | 2000-170559 | A | 6/2000 |
| JP | 2007-303303 | A | 11/2007 |
| JP | 2010-209683 | A | 9/2010 |

* cited by examiner

SIX-STROKE ENGINE AND METHOD OF OPERATING SIX-STROKE ENGINE

BACKGROUND OF THE INVENTION

1. Field of the Invention

The present invention relates to a six-stroke engine in which after an exhaust stroke, a piston makes one reciprocating motion, and an intake stroke is then executed, and a method of operating the six-stroke engine.

2. Description of the Related Art

An engine is required to improve fuel consumption and output. To implement this, the thermal efficiency of the engine needs to be further improved.

The thermal efficiency of the engine is able to be improved by facilitating cooling of the cylinder, advancing the ignition timing, or raising the compression ratio. An example of a conventional engine that cools the cylinder is a six-stroke engine in which after an exhaust stroke, the piston makes one reciprocating motion, and an intake stroke is then executed.

The six-stroke engine sequentially executes six strokes, that is, four strokes including an intake stroke, a compression stroke, an expansion stroke, and an exhaust stroke and additional scavenging strokes including a second intake stroke and a second exhaust stroke to facilitate cooling.

The six-stroke engine of this type mainly has two problems, as will be described below. As the first problem, since the intake valve opens in the second intake stroke, and new air is inhaled, a pumping loss occurs. As the second problem, the exhaust valve opens in the second exhaust stroke, and air that contains oxygen unconsumed by combustion is discharged to the exhaust passage. The oxygen amount in the air is detected by an $O_2$ sensor in the exhaust passage, and the air-fuel ratio is calculated as an abnormal value. In addition, since an excessive amount of oxygen flows into the catalyst in the exhaust passage, the exhaust gas cannot sufficiently be cleaned.

These problems can be solved by using a six-stroke engine operating method described in Japanese Patent Laid-Open No. 2007-303303. The six-stroke engine operating method disclosed in Japanese Patent Laid-Open No. 2007-303303 is executed by keeping the exhaust valve open from the "exhaust stroke" up to the start of the "intake stroke", instead of executing the second intake stroke and the second exhaust stroke. That is, the exhaust valve is not closed even after the exhaust stroke and is kept open from the end of the cooling period to the start of the intake stroke.

According to this method, when the piston lowers after the exhaust stroke, the burned gas in the exhaust passage is inhaled into the cylinder. The burned gas in the cylinder is discharged to the exhaust passage in the subsequent piston rise process.

When this operating method is used, it is possible to cool the interior of the cylinder using the burned gas that is temporarily discharged to the exhaust passage to lower the temperature while suppressing a pumping loss. Japanese Patent Laid-Open No. 2007-303303 also discloses an operating method for further cooling the interior of the cylinder by injecting water into the cylinder during the cooling period between the exhaust stroke and the intake stroke.

The six-stroke engine operating method disclosed in Japanese Patent Laid-Open No. 2007-303303 mainly has the following three problems.

As the first problem, the interior of the cylinder is not cooled as expected. This is because the difference between the temperature in the cylinder and the temperature of the burned gas inhaled into the cylinder during the cooling period is small.

As the second problem, a large quantity of burned gas flows into the cylinder during the cooling period. That is, since the intake stroke starts in a state in which a large amount of burned gas remains in the combustion chamber, the ratio of the burned gas in the cylinder is high after the end of the intake stroke in many operation ranges. Additionally, at the time of valve overlap when starting the intake stroke, it is highly possible that the burned gas in the combustion chamber flows back to the intake passage due to a pressure difference.

The third problem arises in a case in which the operating method of injecting water into the cylinder to enhance the cooling effect is used. That is, the engine needs to be equipped with auxiliary units such as an injector for water injection and a water storage tank, resulting in a bulky engine.

SUMMARY OF THE INVENTION

Preferred embodiments of the present invention have been made to solve these problems, and provide a six-stroke engine that raises the thermal efficiency by properly performing gas exchange in the cylinder, and obtaining a high cooling effect using only the components of the engine, and a method of operating the six-stroke engine.

According to a preferred embodiment of the present invention, a six-stroke engine includes a cylinder, a piston that is inserted into the cylinder and reciprocates between a bottom dead center and a top dead center, a cylinder head attached to the cylinder, a combustion chamber defined by the cylinder, the piston, and the cylinder head, an intake port in the cylinder head and including a downstream end open to the combustion chamber, an exhaust port in the cylinder head and including an upstream end open to the combustion chamber, an intake valve provided in the cylinder head and that opens/closes the intake port, an exhaust valve provided in the cylinder head and that opens/closes the exhaust port, a fuel injector that injects fuel into at least one of the combustion chamber and the intake port, an ignition plug attached to a wall of the combustion chamber, and a valve gear that operates the intake valve and the exhaust valve to execute six strokes including an intake stroke, a compression stroke with ignition, an expansion stroke with combustion, an exhaust stroke, an expansion stroke without combustion, and a compression stroke without ignition, in this order, wherein, within a period from the exhaust stroke to the intake stroke, the valve gear opens at least one of the intake valve that was closed in the exhaust stroke and the exhaust valve that was closed in the intake stroke only for a predetermined period of time while the piston is located on a side of the top dead center, and then closes the at least one of the intake valve and the exhaust valve, and a valve overlap state is produced at least once within the period from the exhaust stroke to the intake stroke.

According to another preferred embodiment of the present invention, a method of operating a six-stroke engine including a cylinder, a piston that is inserted into the cylinder and that reciprocates between a bottom dead center and a top dead center, a cylinder head attached to the cylinder, a combustion chamber defined by the cylinder, the piston, and the cylinder head, an intake port in the cylinder head and including a downstream end open to the combustion chamber, an exhaust port in the cylinder head and including an upstream end open to the combustion chamber, an intake valve provided in the cylinder head and that opens/closes the intake port, an exhaust valve provided in the cylinder head and that opens/closes the exhaust port, a fuel injector that injects fuel into at least one of the combustion chamber and the intake port, and an ignition plug attached to a wall of the combustion chamber, the method including executing, for the engine, six strokes including an intake stroke, a compression stroke with ignition, an expansion stroke with combustion, an exhaust stroke, an expansion stroke without combustion, and a compression stroke without ignition, in this order, and opening at least one of the intake valve that was closed in the exhaust stroke and the exhaust valve that was closed in the intake stroke only for a predetermined period of time while the piston is located on a side of the top dead center, and then closing the at least one of the intake valve and the exhaust valve, to produce a valve overlap state at least once within a period from the exhaust stroke to the intake stroke.

With the six-stroke engine and the method of operating the six-stroke engine according to preferred embodiments of the present invention, cooling in the cylinder is facilitated during the cooling period in which the expansion stroke without combustion and the compression stroke without ignition are executed. This cooling is executed using only the basic components of the engine. Additionally, in the six-stroke engine, the valve overlap state is produced between the exhaust stroke and the intake stroke. Hence, the burned gas in the cylinder is pushed out to the exhaust passage, and gas exchange in the cylinder is performed.

When the valve overlap state is produced, the piston is located near the top dead center. For this reason, the volume of the combustion chamber is small, and sufficient gas exchange is performed by opening the intake valve slightly. Since gas exchange in the cylinder is efficiently performed while significantly reducing or minimizing the amount of new air discharged to the exhaust passage, the combustion is improved, and the thermal efficiency is high.

In addition, since the surface area of the combustion chamber preferably is almost at its minimum at this time, the combustion chamber is also able to be cooled efficiently. Furthermore, since the moving amount of the piston is small at this time, a pumping loss is significantly reduced or minimized.

Hence, according to various preferred embodiments of the present invention, it is possible to provide a six-stroke engine that raises the thermal efficiency by properly performing gas exchange in the cylinder, and obtaining a high cooling effect using only the components of the engine.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

A six-stroke engine and a method of operating the six-stroke engine according to a first preferred embodiment of the present invention will be described below in detail with reference to FIGS. 1 to 6.

Figure 1:
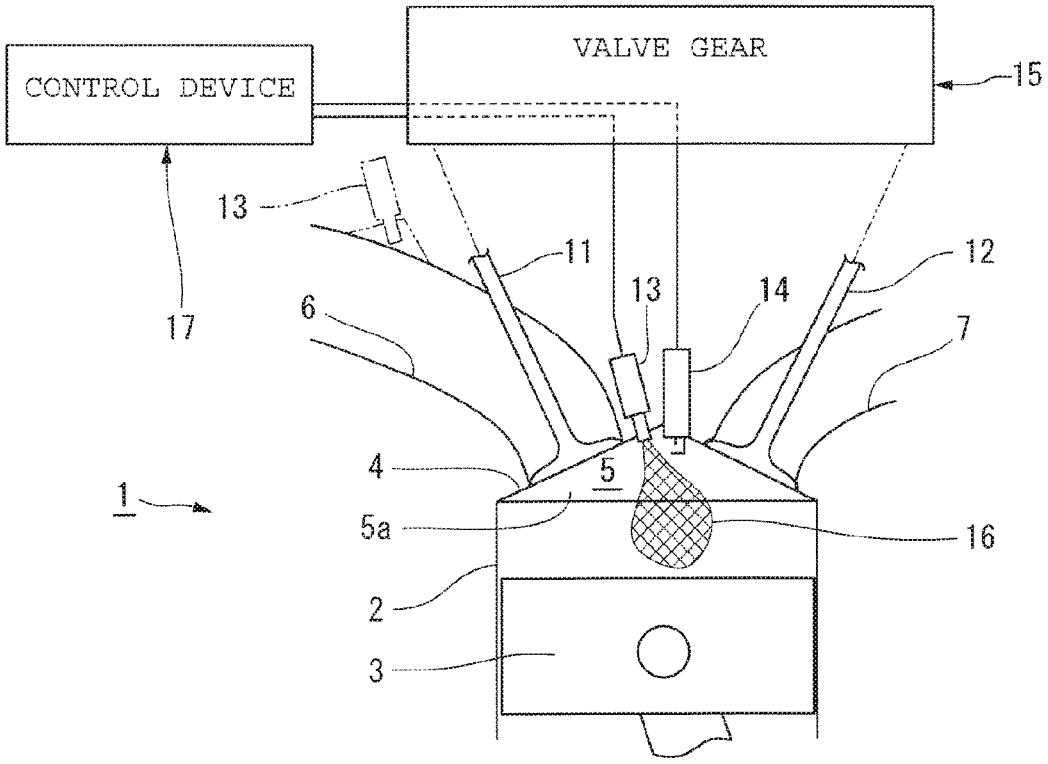
FIG. 1 is a sectional view showing the arrangement of the main portions of a six-stroke engine according to a first preferred embodiment of the present invention.

A six-stroke engine 1 shown in FIG. 1 is executes a method of operating a six-stroke engine according to a preferred embodiment of the present invention, and includes a cylinder 2, a piston 3, and a cylinder head 4. The six-stroke engine 1 may be a single cylinder engine or a multiple cylinder engine. The six-stroke engine 1 may also be a serial multiple cylinder engine (in-line) or a V-type engine.

The cylinder 2 and the cylinder head 4 are cooled by a water cooling device (not shown).

The piston 3 is movably fitted in the cylinder 2, and in a state in which the piston 3 is inserted in the cylinder 2, reciprocates between the top dead center and the bottom dead center.

The cylinder head 4 defines a combustion chamber 5 in cooperation with the cylinder 2 and the piston 3 described above. The combustion chamber 5 is surrounded by the cylinder 2, the piston 3, and the cylinder head 4.

An intake port 6 and an exhaust port 7 are provided in the cylinder head 4. The downstream end of the intake port 6 is open to the combustion chamber 5. The upstream side of the intake port 6 is connected to an intake unit (not shown) including a throttle valve. The upstream end of the exhaust port 7 is open to the combustion chamber 5. The downstream side of the exhaust port 7 is connected to an exhaust unit (not shown) including a catalyst.

The cylinder head 4 includes an intake valve 11, an exhaust valve 12, a fuel injector 13, an ignition plug 14, and a valve gear 15.

The intake valve 11 opens/closes the intake port 6. The intake valve 11 is driven by the valve gear 15 (to be described below).

The exhaust valve 12 opens/closes the exhaust port 7. The exhaust valve 12 is driven by the valve gear 15 (to be described below).

The fuel injector 13 is preferably provided at at least one of a position indicated by a solid line between the ignition plug 14 and the intake valve 11 in FIG. 1 and a position indicated by an alternate long and two short dashed line on the intermediate portion of the intake port 6 in FIG. 1. The fuel injector 13 indicated by the solid line in FIG. 1 directly injects fuel 16 into the combustion chamber 5. The fuel injector 13 that directly injects fuel into the combustion chamber 5 will simply be referred to as a cylinder injector hereinafter.

The fuel injector 13 indicated by the alternate long and two short dashed line in FIG. 1 injects fuel into the intake port 6. The fuel injector 13 that injects fuel into the intake port 6 will be referred to as an intake port injector hereinafter. That is, the six-stroke engine 1 according to this preferred embodiment includes the fuel injector 13 that injects fuel into at least one of the combustion chamber 5 and the intake port 6.

The timing at which the cylinder injector 13 or the intake port injector 13 injects the fuel 16 is controlled by a controller 17 for the engine.

The ignition plug 14 is attached to the center of a ceiling wall 5*a* of the combustion chamber 5. The ceiling wall 5*a* preferably has a circular or substantially circular shape when viewed from the axial direction of the cylinder 2. The ignition timing of the ignition plug 14 is controlled by the controller 17.

Figure 2:
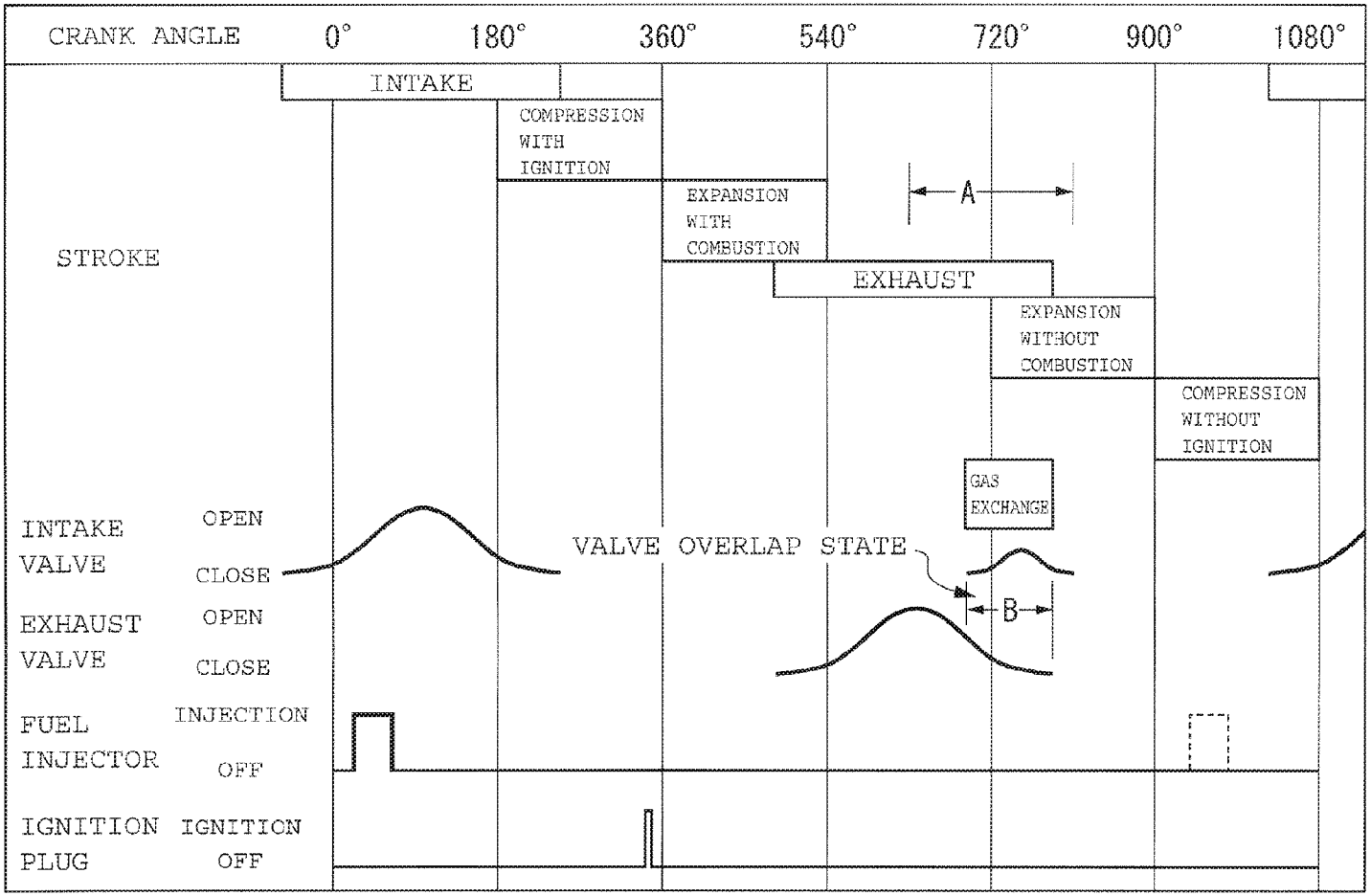
FIG. 2 is a timing chart for explaining a method of operating the six-stroke engine according to the first preferred embodiment of the present invention.

The valve gear 15 operates the intake valve 11 and the exhaust valve 12 so as to sequentially execute six strokes (to be described below). As shown in FIG. 2, the six strokes are an intake stroke, a compression stroke with ignition, an expansion stroke with combustion, an exhaust stroke, an expansion stroke without combustion, and a compression stroke without ignition.

In the intake stroke, the piston 3 moves from the top dead center to the bottom dead center in a state in which the intake valve 11 is open with the exhaust valve 12 is closed, and new air is inhaled into the cylinder 2. Note that the movement of the piston 3 from the top dead center to the bottom dead center will simply be referred to as "the piston 3 lowers". The movement of the piston 3 from the bottom dead center to the top dead center will simply be referred to as "the piston 3 rises" hereinafter. The intake stroke ends when the intake valve 11 closes. The exhaust valve 13 is kept closed until opened by the valve gear 15 in the exhaust stroke (to be described below). When the cylinder injector 13 is provided as the fuel injector, the cylinder injector 13 directly injects the fuel 16 into the combustion chamber 5 in the intake stroke. Note that when the intake port injector 13 is provided as the fuel injector, the intake port injector 13 injects the fuel 16 into the intake port 6 in the compression stroke without ignition (to be described later). FIG. 2 shows the fuel injection timing of the cylinder injector 13 by a thick line and the fuel injection timing of the intake port injector 13 by a broken line.

In the compression stroke with ignition, the piston 3 rises in a state in which the intake valve 11 and the exhaust valve 12 are closed, and the air in the cylinder 2 is compressed. The above-described fuel injector 13 injects the fuel 16 in the compression stroke with ignition. The ignition plug 14 is energized to ignite the fuel 16 at the end of this stroke.

In the expansion stroke with combustion, the piston 3 lowers due to a combustion pressure in the state in which the intake valve 11 and the exhaust valve 12 are closed.

In the exhaust stroke, the piston 3 rises in a state in which the exhaust valve 12 is open, and the exhaust gas in the cylinder 2 is discharged to the exhaust port 7. The six-stroke engine according to this preferred embodiment preferably performs an operating method within the period from the second half of the exhaust stroke to the first half of the next expansion stroke without combustion. The method of operating the six-stroke engine produces a valve overlap state in which both the intake valve 11 and the exhaust valve 12 are open within the period from the second half of the exhaust stroke to the first half of the expansion stroke without combustion.

That is, the valve gear 15 opens the intake valve 11, which has been closed so far, only for a predetermined period of time when the exhaust stroke and the expansion stroke without combustion are executed, and the piston 3 is located on the top dead center side. "When the piston 3 is located on the top dead center side" means a period of time after the position of the piston 3 has passed a position of 90° after the bottom dead center in the exhaust stroke until the position of the piston 3 reaches a position of 90° after the top dead center in the expansion stroke without combustion, as indicated by a period A in FIG. 2.

The valve overlap state is produced during a period indicated by a period B in FIG. 2. As the valve overlap state is produced, the burned gas in the cylinder 2 is pushed out to the exhaust passage by intake air, and gas exchange in the cylinder 2 is performed.

In the expansion stroke without combustion, the piston 3 lowers in a state in which the intake valve 11 and the exhaust valve 12 are closed after the period in which the valve overlap state is obtained, and air is expanded in the cylinder 2.

In the compression stroke without ignition, the piston 3 rises in the state in which the intake valve 11 and the exhaust valve 12 are closed, and the air expanded in the cylinder 2 is restored.

That is, the valve gear 15 implements the valve overlap state once within the period from the exhaust stroke to the intake stroke via the expansion stroke without combustion and the compression stroke without ignition.

Figure 3:
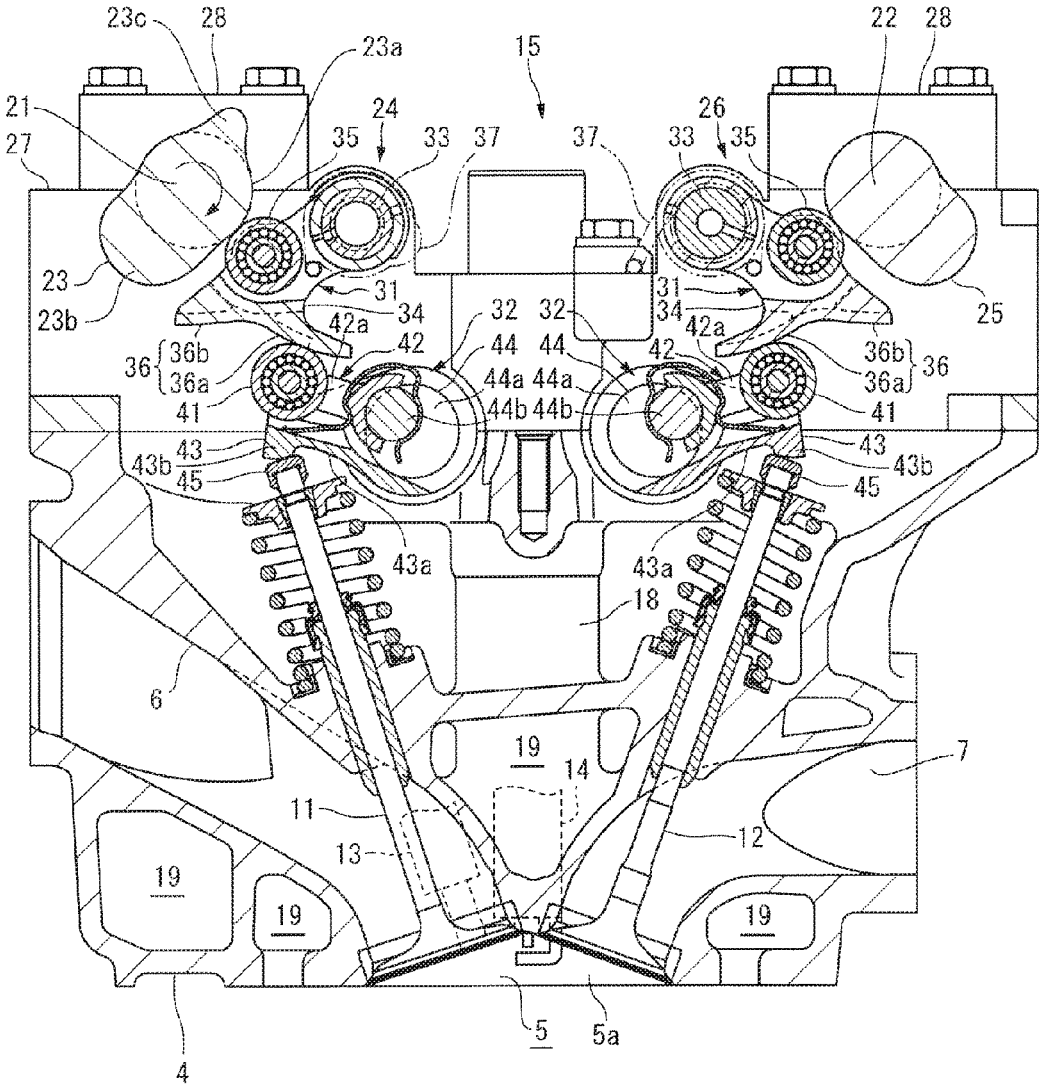
FIG. 3 is a sectional view of a cylinder head used in the six-stroke engine according to the first preferred embodiment of the present invention.

The valve gear 15 that executes the method of operating the six-stroke engine is configured as shown in FIG. 3. The same reference numerals as described with reference to FIG. 1 denote the same or similar members in FIG. 3, and a detailed description thereof will appropriately be omitted.

The ceiling wall 5*a* of the combustion chamber 5, the intake port 6 and the exhaust port 7, an injector storage (not shown), an ignition plug storage 18, a cooling water jacket 19, and the like are provided in the cylinder head 4 shown in FIG. 3.

Each of the intake port 6 and the exhaust port 7 of the cylinder head 4 preferably has a shape that forks into two branches inside the cylinder head 4. For this reason, two intake valves 11 and two exhaust valves 12 are provided per cylinder.

The valve gear 15 shown in FIG. 3 includes an intake camshaft 21 that drives the intake valve 11, and an exhaust camshaft 22 that drives the exhaust valve 12.

Each of the intake camshaft 21 and the exhaust camshaft 22 makes one rotation while a crankshaft (not shown) makes three rotations. The rotation of the intake camshaft 21 is converted into a reciprocating motion by an intake cam 23 provided on the intake camshaft 21 and an intake valve driving mechanism 24, and transmitted to the intake valve 11. The rotation of the exhaust camshaft 22 is converted into a reciprocating motion by an exhaust cam 25 provided on the exhaust camshaft 22 and an exhaust valve driving mechanism 26, and transmitted to the exhaust valve 12. The rotation direction of the intake camshaft 21 according to this preferred embodiment is clockwise in FIG. 3.

Each of the intake camshaft 21 and the exhaust camshaft 22 is rotatably supported by a support member 27 and a cam cap 28. The support member 27 is attached to the cylinder head 4. The cam cap 28 is attached to the support member 27 in a state in which the cam cap 28 and the support member 27 sandwich the intake camshaft 21 or the exhaust camshaft 22.

The intake cam 23 of the intake camshaft 21 is provided for each intake valve 11. The exhaust cam 25 of the exhaust camshaft 22 is provided for each exhaust valve 12.

The intake cam 23 according to this preferred embodiment preferably includes a circular base portion 23*a*, a first nose portion 23*b*, and a second nose portion 23*c*. The circular base portion 23*a* does not open the intake valve 11. The first nose portion 23*b* executes the intake stroke. The second nose portion 23*c* implements the above-described overlap state. The second nose portion 23*c* projects a small distance from the circular base portion 23*a* and becomes narrow in the rotation direction, as compared to the first nose portion 23*b*.

The intake valve driving mechanism 24 converts the rotation of the intake cam 23 into a reciprocating motion and transmits it to the intake valve 11. The exhaust valve driving mechanism 26 converts the rotation of the exhaust cam 25 into a reciprocating motion and transmits it to the exhaust valve 12. The exhaust valve driving mechanism 26 is different from the intake valve driving mechanism 24 in that the driving target is only the exhaust valve 12. However, the remaining components of the exhaust valve driving mechanism 26 are the same as in the intake valve driving mechanism 24. Hence, the same reference numerals as in the intake valve driving mechanism 24 denote members having similar functions in the exhaust valve driving mechanism 26, and a detailed description thereof will appropriately be omitted.

The intake valve driving mechanism 24 includes a swing cam 31 located near the intake camshaft 21, and a rocker arm 32 located between the swing cam 31 and the intake valve 11. The swing cam 31 and the rocker arm 32 are provided for each intake valve 11.

The swing cam 31 includes a swing cam body 34 swingably supported by a support shaft 33 parallel or substantially parallel to the intake camshaft 21, and a roller 35 rotatably attached to the swing cam body 34.

The support shaft 33 is provided at a position spaced apart from the intake camshaft 21 to the side of the exhaust camshaft 22 and supported by the support member 27.

A cam surface 36 that comes into contact with the rocker arm 32 (to the described below) is provided at the swing end of the swing cam body 34. The cam surface 36 is defined by a circular base portion 36*a* and a lift portion 36*b*. The circular base portion 36*a* preferably has an arcuate shape with respect to the axis of the support shaft 33 as the center when viewed from the axial direction of the intake camshaft 21. The lift portion 36*b* gradually increases its distance from the axis of the support shaft 33 as it separates from the circular base portion 36*a*.

The roller 35 is attached to the swing cam body 34 so as to project from the swing cam body 34 toward the intake camshaft 21. The axis of the roller 35 is parallel or substantially parallel to the axis of the intake camshaft 21. The roller 35 rotates in contact with the intake cam 23. The swing cam 31 according to this preferred embodiment is biased by a helical torsion coil spring 37 so that the roller 35 is always in contact with the intake cam 23. The helical torsion coil spring 37 is supported by the support shaft 33 in a state in which the support shaft 33 extends through the helical torsion coil spring 37.

The rocker arm 32 uses an arrangement to transmit the swing operation of the swing cam 31 to the intake valve 11 by a plurality of swing members. The plurality of members include a control arm 42 including a roller 41 in contact with the cam surface 36 of the swing cam 31, and a rocker arm body 43 in contact with the intake valve 11. The control arm 42 and the rocker arm body 43 are swingably supported by a rocker shaft 44.

The rocker shaft 44 is rotatably supported by the cylinder head 4 and the support member 27 in a state in which its axis is parallel or substantially parallel to that of the intake camshaft 21. The rocker shaft 44 preferably has a so-called crankshaft shape. That is, the rocker shaft 44 includes a main shaft 44*a* located on the same axis as that of the portion supported by the cylinder head 4 and the support member 27, and an eccentric pin 44*b* decentered from the main shaft 44*a*. The rocker arm body 43 is swingably supported by the main shat 44*a*.

The control arm 42 is swingably supported by the eccentric pin 44*b*.

A driving mechanism such as a servo motor (not shown) is connected to one end of the rocker shaft 44. The rocker shaft 44 is rotated through a predetermined pivot angle by driving of the driving mechanism.

An arm 43*a* that a control arm body 42*a* of the control arm 42 (to be described below) contacts, and a press element 43*b* that presses a shim 45 of the intake valve 11 are provided on the rocker arm body 43.

The control arm 42 includes the control arm body 42*a* pivotally supported by the eccentric pin 44*b*, and the roller 41 rotatably provided at the swing end of the control arm body 42*a*.

The swing end of the control arm body 42*a* has a shape such that it comes into contact with the arm 43*a* of the rocker arm body 43 from the upper side in FIG. 3.

The control arm 42 moves in the longitudinal direction of the arm 43*a* as the rocker shaft 44 rotates, and the position of the eccentric pin 44*b* changes.

In a case in which the control arm 42 moves in a direction to come close to the intake camshaft 21, the lift portion 36*b* of the cam surface 36 presses the roller 41 relatively, and the intake valve 11 opens relatively large. In a case in which the control arm 42 moves in a direction to separate from the intake camshaft 21, the roller 41 comes into contact with only the circular base portion 36*a* of the cam surface 36, and the intake valve 11 is kept closed. The opening/closing timing and lift amount of the intake valve 11 is freely set for the engine operation state by continuously changing the position of the eccentric pin 44*b*.

According to the six-stroke engine 1 of this preferred embodiment, the expansion stroke without combustion and the compression stroke without ignition are executed. Hence, the period in which these strokes are executed serves as a cooling period, and cooling in the cylinder 2 is facilitated. This cooling is executed using only the basic components of the six-stroke engine 1.

Additionally, in the six-stroke engine 1, the intake camshaft 21 rotates, and the second nose portion 23*c* of the intake cam 23 presses the roller 35 to implement the valve overlap state within the period from the second half of the exhaust stroke to the first half of the next expansion stroke without combustion. As the valve overlap state is produced, the burned gas in the cylinder 2 is pushed out to the exhaust passage (exhaust port 7) by intake air, and gas exchange in the cylinder 2 is performed.

When the valve overlap state is produced, the piston 3 is located near the top dead center. For this reason, the volume of the combustion chamber 5 is small, and sufficient gas exchange is performed by opening the intake valve 11 slightly. Since gas exchange in the cylinder 2 is efficiently performed while significantly reducing or minimizing the amount of new air discharged to the exhaust passage, the combustion is improved, and the thermal efficiency becomes high.

In addition, since the surface area of the combustion chamber 5 preferably is almost at its minimum at this time, the combustion chamber 5 is also cooled efficiently. Furthermore, since the moving amount of the piston 3 is small at this time, a pumping loss is significantly reduced or minimized.

Hence, according to this preferred embodiment, it is possible to provide a six-stroke engine that raises the thermal efficiency by properly performing gas exchange in the cylinder 2, and obtaining a high cooling effect using only the components of the engine, and a method of operating the six-stroke engine.

The valve gear 15 according to this preferred embodiment opens and closes the intake valve 11 to produce the valve overlap state within the period after the position of the piston 3 has passed a position of 90° after the bottom dead center in the exhaust stroke until the position of the piston 3 reaches a position of 90° after the top dead center in the expansion stroke without combustion.

For this reason, in a state in which no burned gas or only a small amount of burned gas remains in the cylinder 2, the expansion stroke without combustion and the compression stroke without ignition are executed, and the interior of the cylinder 2 is efficiently cooled.

Hence, according to this preferred embodiment, it is possible to provide a six-stroke engine that makes the thermal efficiency higher because cooling in the cylinder 2 is further facilitated, and a method of operating the six-stroke engine.

Figure 4:
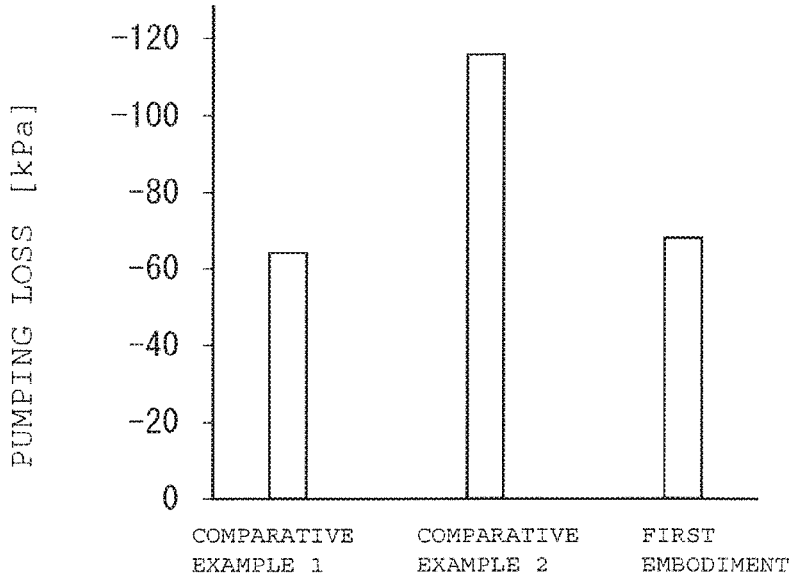
FIG. 4 is a graph showing the magnitude of a pumping loss.

When a prototype of the six-stroke engine according to this preferred embodiment was built, and a pumping loss was measured, a result as shown in FIG. 4 was obtained. Referring to FIG. 4, Comparative Example 1 shows a result in a case in which the intake valve was kept closed during the period from the exhaust stroke to the expansion stroke without combustion. Comparative Example 2 shows a result in a case in which the intake valve was opened in a state in which the exhaust valve was closed in the expansion stroke without combustion, and the exhaust valve was opened in a state in which the intake valve was closed in the compression stroke without ignition.

As is apparent from FIG. 4, according to the six-stroke engine and the method of operating the six-stroke engine according to this preferred embodiment, the increase in the pumping loss is very small although the intake valve 11 opens twice as compared to Comparative Example 1 in which the intake valve opens only in the intake stroke. In addition, when this preferred embodiment is used, the pumping loss becomes much smaller than in the engine of Comparative Example 2.

Figure 5A:
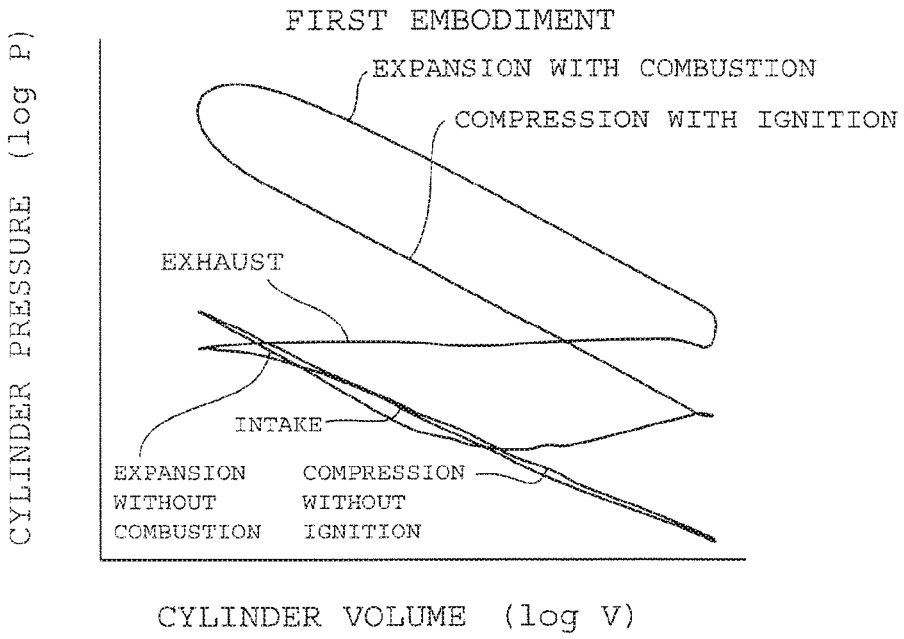
FIG. 5A is a P-V chart showing changes in the cylinder volume and the cylinder pressure of the six-stroke engine according to the first preferred embodiment of the present invention.
Figure 5B:
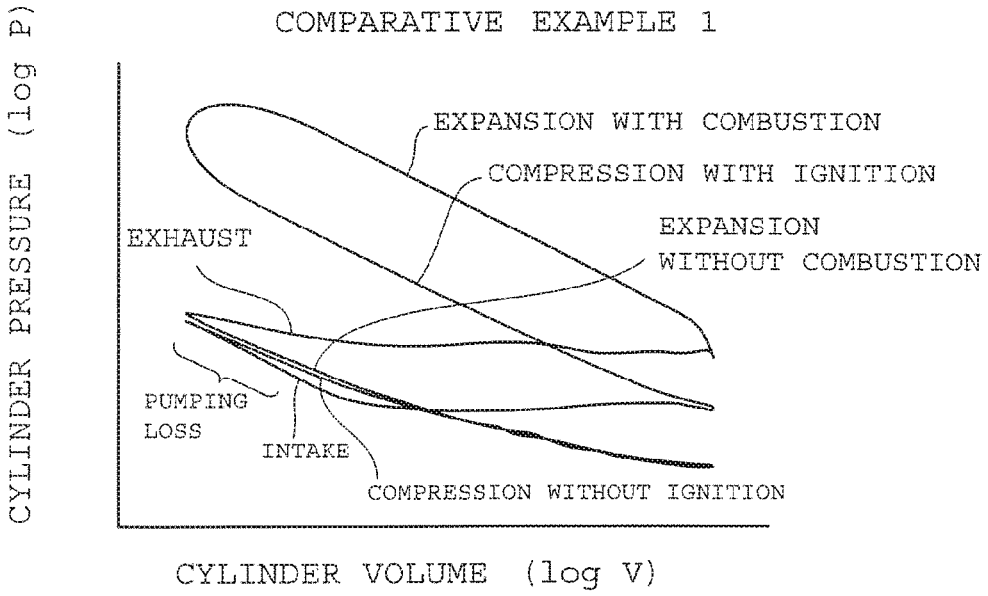
FIG. 5B is a P-V chart showing changes in the cylinder volume and the cylinder pressure of a six-stroke engine according to Comparative Example 1.

The relationship (P-V chart) between a change (logV) in the cylinder volume and a change (logP) in the cylinder pressure of the six-stroke engine according to this preferred embodiment is shown in FIG. 5A. FIG. 5B is a P-V chart of the six-stroke engine according to Comparative Example 1, and FIG. 5C is a P-V chart of the six-stroke engine according to Comparative Example 2.

In the six-stroke engine according to this preferred embodiment, as shown in FIG. 5A, the decrease in the cylinder pressure is small in the early stage of the expansion stroke without combustion although the cylinder volume increases. At this time, the pumping loss hardly occurs, as can be seen.

In the six-stroke engine according to Comparative Example 1, as shown in FIG. 5B, in the expansion stroke without combustion, a pumping loss smaller than that in the intake stroke occurs.

Figure 5C:
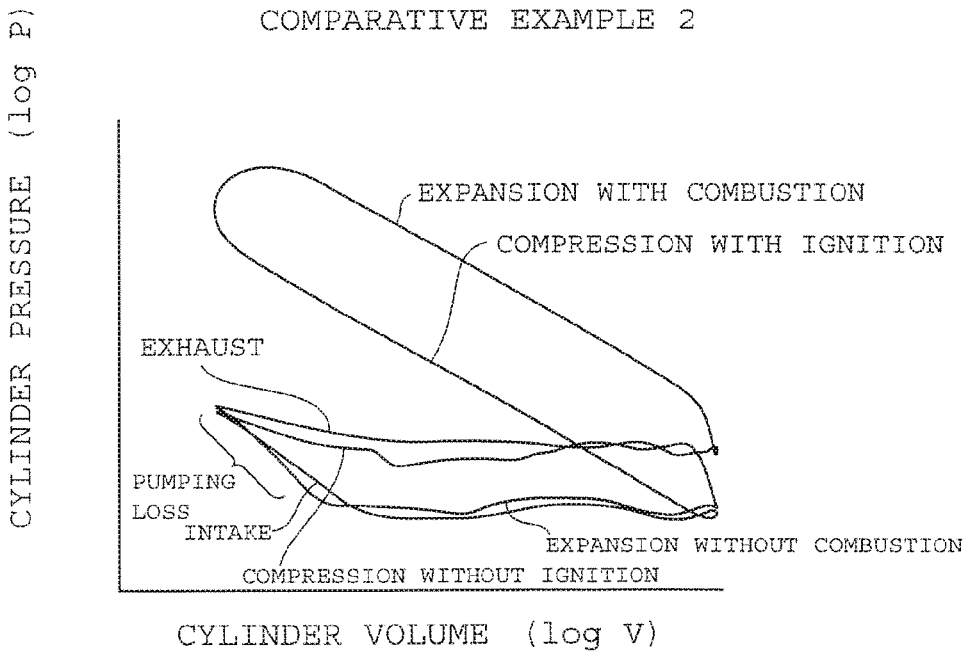
FIG. 5C is a P-V chart showing changes in the cylinder volume and the cylinder pressure of a six-stroke engine according to Comparative Example 2.

In the six-stroke engine according to Comparative Example 2, as shown in FIG. 5C, a large pumping loss occurs in each of the early stage of the intake stroke and the early stage of the expansion stroke without combustion.

Figure 6:
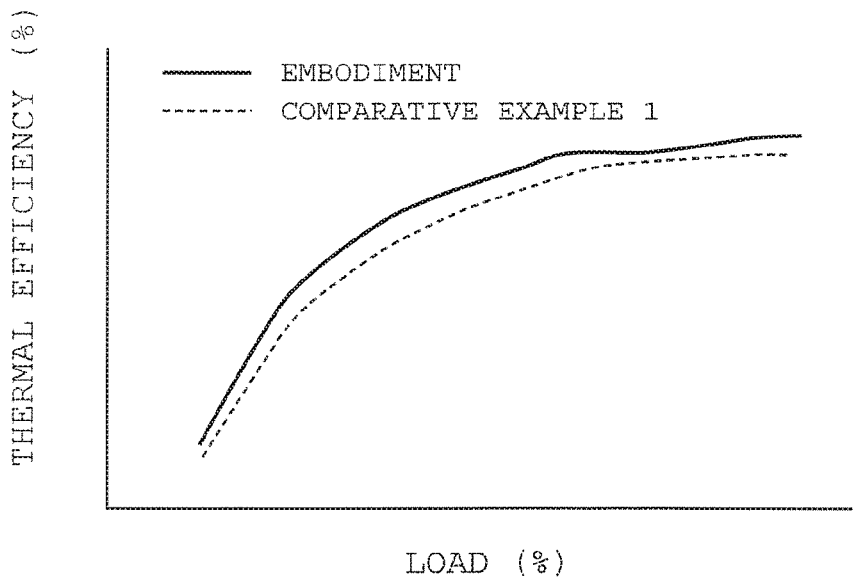
FIG. 6 is a graph showing the relationship between a load and a thermal efficiency.

When the six-stroke engine 1 according to this preferred embodiment was operated, and the thermal efficiency was measured, a result shown in FIG. 6 was obtained. Referring to FIG. 6, the thermal efficiency of the six-stroke engine according to this preferred embodiment is indicated by a solid line, and the thermal efficiency of the six-stroke engine according to Comparative Example 1 is indicated by a broken line. As is apparent from FIG. 6, the six-stroke engine according to this preferred embodiment had a high thermal efficiency throughout the operating range from a low-load operation to a high-load operation, as compared to the six-stroke engine according to Comparative Example 1.

Second Preferred Embodiment

Figure 7:
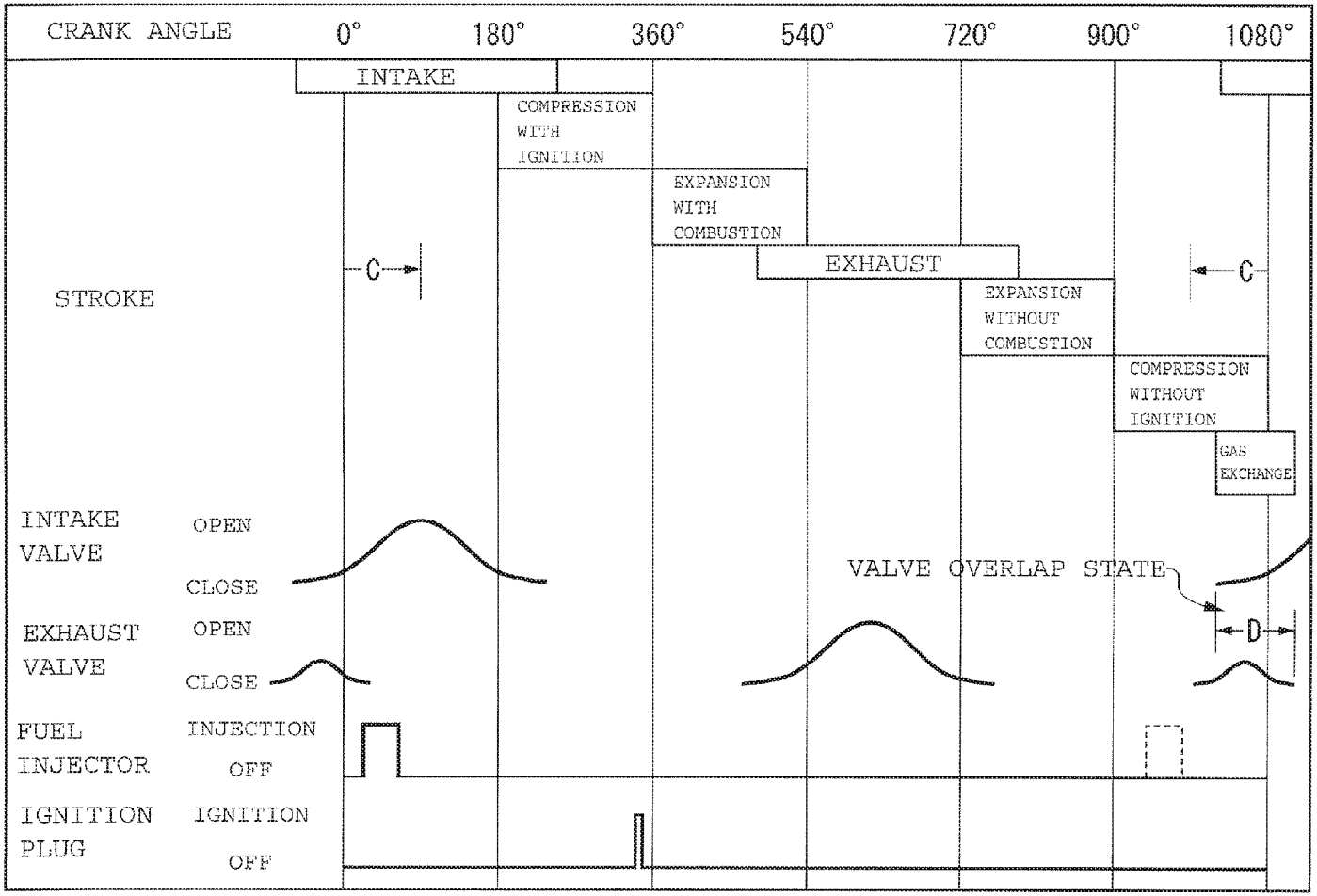
FIG. 7 is a timing chart for explaining a method of operating a six-stroke engine according to a second preferred embodiment of the present invention.
Figure 8:
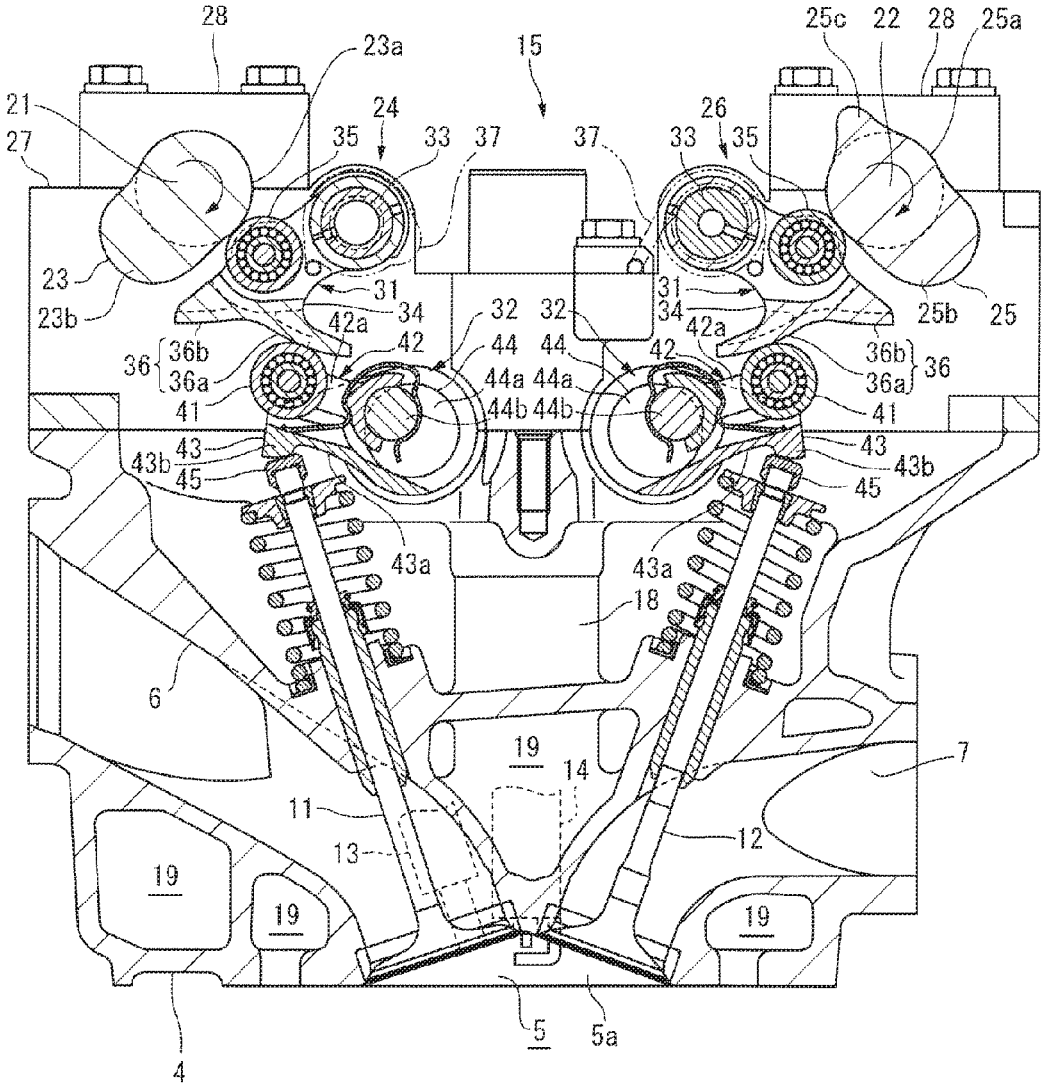
FIG. 8 is a sectional view of a cylinder head used in the six-stroke engine according to the second preferred embodiment of the present invention.

A six-stroke engine and a method of operating the six-stroke engine according to a second preferred embodiment of the present invention is shown in FIGS. 7 and 8. The same reference numerals as described with reference to FIGS. 1 to 6 denote the same or similar members in FIGS. 7 and 8, and a detailed description thereof will appropriately be omitted.

The six-stroke engine and the method of operating the six-stroke engine according to this preferred embodiment are different from the six-stroke engine in a case in which the first preferred embodiment is used only in the operations of an intake valve 11 and an exhaust valve 12. The point of difference is that the exhaust valve 12 is opened/closed within the period from the compression stroke without ignition to the intake stroke, as shown in FIG. 7.

That is, the method of operating the six-stroke engine according to the second preferred embodiment produces a valve overlap state in which both the intake valve 11 and the exhaust valve 12 are open within the period from the second half of the compression stroke without ignition to the first half of the intake stroke.

A valve gear 15 according to this preferred embodiment opens the exhaust valve 12, which was closed so far, only for a predetermined period of time when the compression stroke without ignition and the intake stroke following the stroke are executed, and a piston 3 is located on the top dead center side. The exhaust valve 12 opens prior to the intake valve 11. "When the piston 3 is located on the top dead center side" means a period of time after the position of the piston 3 has passed a position of 90° after the bottom dead center in the compression stroke without ignition until the position of the piston 3 reaches a position of 90° after the top dead center in the intake stroke, as indicated by a period C in FIG. 7. The valve overlap state is produced during a period indicated by a period D in FIG. 7.

The method of operating the six-stroke engine according to this preferred embodiment is executed by the valve gear 15 configured as shown in FIG. 8. The valve gear 15 shown in FIG. 8 is different from the valve gear 15 shown in FIG. 3 only in the shapes of an intake cam 23 and an exhaust cam 25, and the rest of the structure is the same.

The intake cam 23 according to this preferred embodiment includes a circular base portion 23*a* and a first nose portion 23*b*. The exhaust cam 25 includes a circular base portion 25*a*, a first nose portion 25*b*, and a second nose portion 25*c*. The first nose portion 25*b* of the exhaust cam 25 executes the exhaust stroke. The second nose portion 25*c* of the exhaust cam 25 opens/closes the exhaust valve 12 within the period from the compression stroke without ignition to the intake stroke.

It is possible to produce the valve overlap state only during the period D, as shown in FIG. 7, using the valve gear 15 having the above-described arrangement.

As the valve overlap state is produced within the period from the compression stroke without ignition to the intake stroke, intake air is introduced into a cylinder 2 in a state in which the burned gas flows toward the exhaust passage. For this reason, the intake air is hardly blocked by the burned gas when flowing into the cylinder 2. Hence, according to this preferred embodiment, since the intake air filling efficiency is increased, it is possible to provide a six-stroke engine having a higher thermal efficiency and a method of operating the six-stroke engine.

Third Preferred Embodiment

Figure 9:
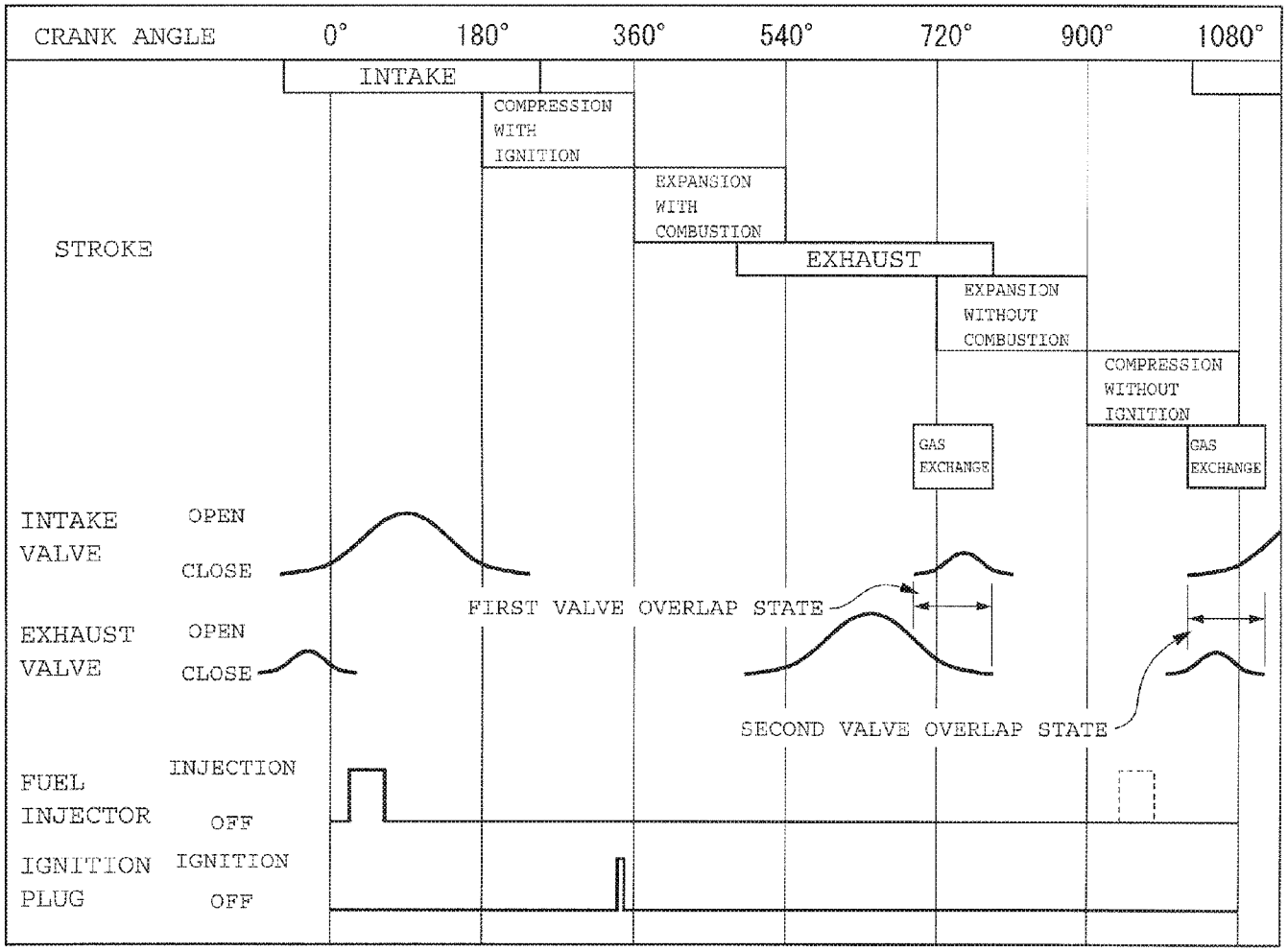
FIG. 9 is a timing chart for explaining a method of operating a six-stroke engine according to a third preferred embodiment of the present invention.
Figure 10:
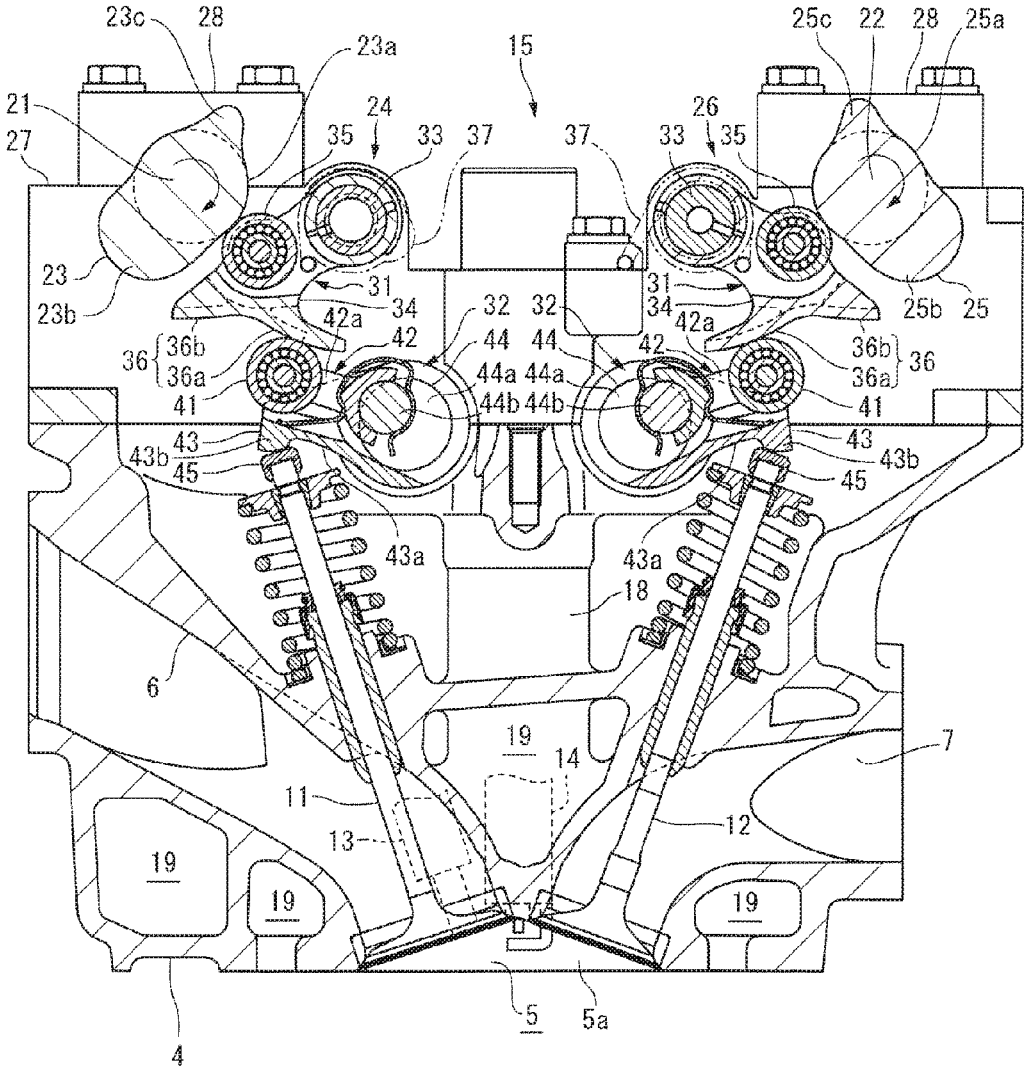
FIG. 10 is a sectional view of a cylinder head used in the six-stroke engine according to the third preferred embodiment of the present invention.

A six-stroke engine and a method of operating the six-stroke engine according to a third preferred embodiment of the present invention is shown in FIGS. 9 and 10. The same reference numerals as described with reference to FIGS. 1 to 8 denote the same or similar members in FIGS. 9 and 10, and a detailed description thereof will appropriately be omitted.

The six-stroke engine and the method of operating the six-stroke engine according to this preferred embodiment have both the characteristic feature of the above-described first preferred embodiment and the characteristic feature of the second preferred embodiment as shown in FIG. 9. That is, a valve gear 15 according to this preferred embodiment uses an arrangement that produces a first valve overlap state and a second valve overlap state within the period from the exhaust stroke to the intake stroke via the expansion stroke without combustion and the compression stroke without ignition.

The first valve overlap state is produced by opening and closing an intake valve 11 within a period of time after the position of a piston 3 has passed a position of 90° after the bottom dead center in the exhaust stroke until the position of the piston 3 reaches a position of 90° after the top dead center in the expansion stroke without combustion.

The second valve overlap state is produced by opening and closing an exhaust valve 12 within a period of time after the position of the piston 3 has passed a position of 90° after the bottom dead center in the compression stroke without ignition until the position of the piston 3 reaches a position of 90° after the top dead center in the intake stroke.

As described above, in the six-stroke engine and the method of operating the six-stroke engine according to this preferred embodiment, valve overlap is produced both halfway through the process from the exhaust stroke to the expansion stroke without combustion and halfway through the process from the compression stroke without ignition to the intake stroke.

For this reason, since gas exchange in a cylinder 2 is performed twice during the cooling period between the exhaust stroke and the intake stroke, the amount of the burned gas remaining in the cylinder 2 further decreases. Hence, according to this preferred embodiment, it is possible to provide a six-stroke engine having a high thermal efficiency and a method of operating the six-stroke engine.

Fourth Preferred Embodiment

A six-stroke engine and a method of operating the six-stroke engine according to a fourth preferred embodiment of the present invention is shown in FIGS. 11 to 17. The same reference numerals as described with reference to FIGS. 1 to 10 denote the same or similar members in FIGS. 11 to 17, and a detailed description thereof will appropriately be omitted.

Figure 11:
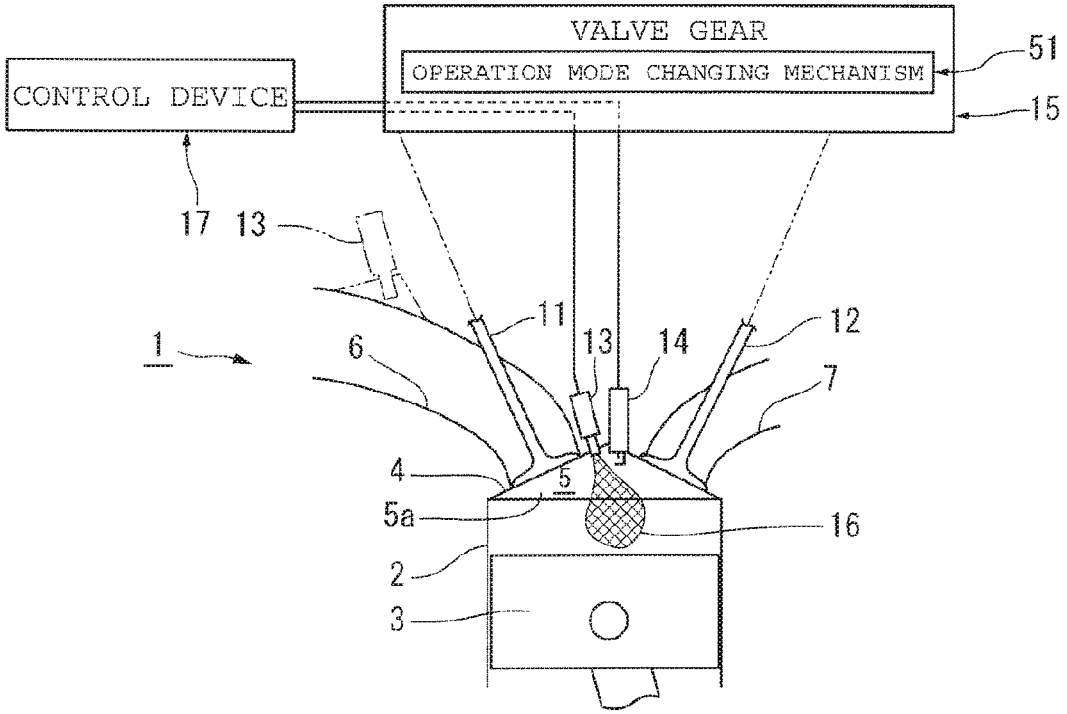
FIG. 11 is a sectional view showing the arrangement of the main portions of a six-stroke engine according to a fourth preferred embodiment of the present invention.

A valve gear 15 of a six-stroke engine 1 according to this preferred embodiment uses at least one of two types of operation modes, as will be described below in detail. For this purpose, the valve gear 15 includes an operation mode changing mechanism 51 that switches the operation mode, as shown in FIG. 11.

Figure 12:
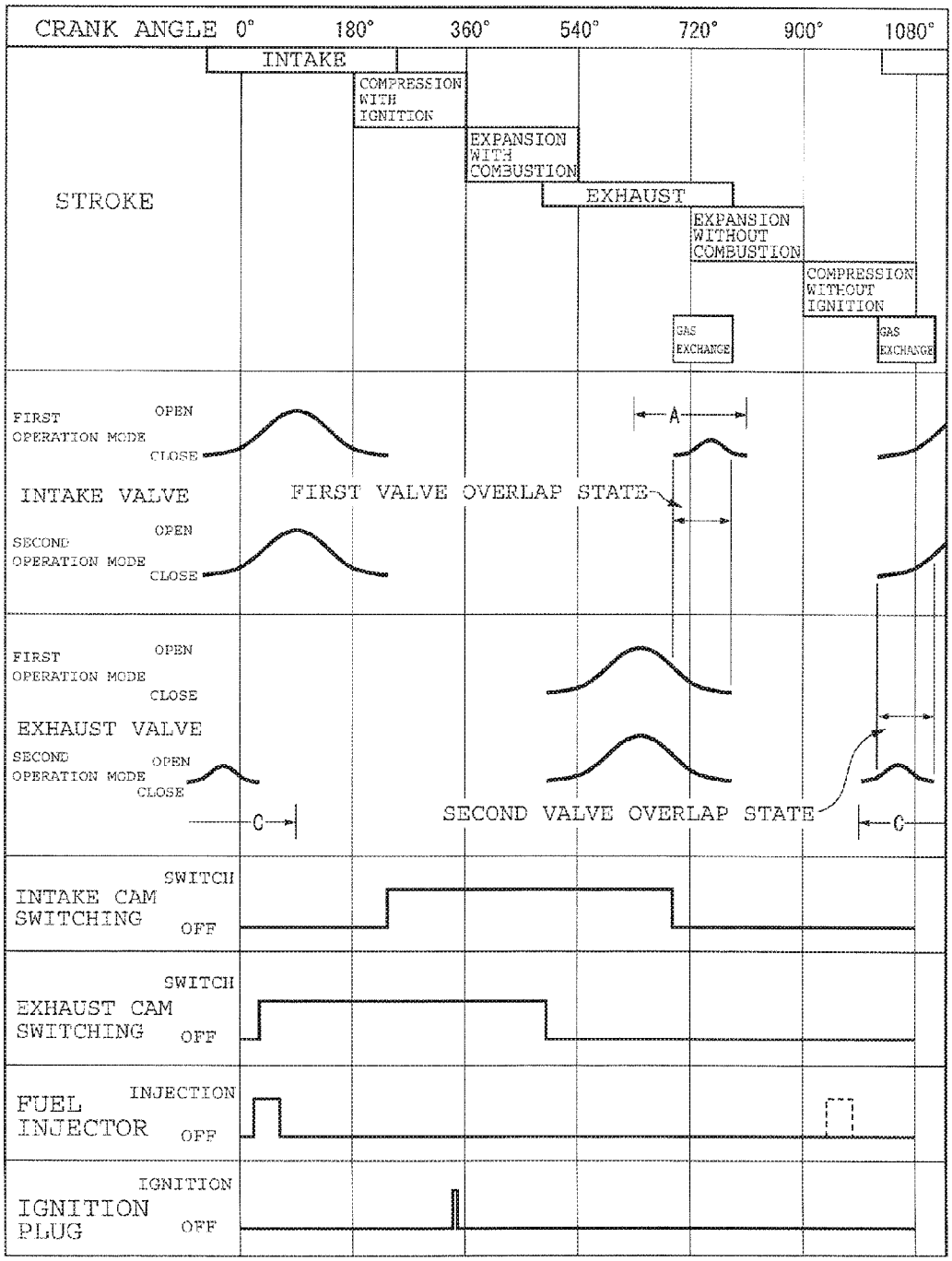
FIG. 12 is a timing chart for explaining a method of operating the six-stroke engine according to the fourth preferred embodiment of the present invention.

Of the two types of operation modes, the first operation mode is an operation mode in which an intake valve 11 opens/closes within the period from the exhaust stroke to the expansion stroke without combustion, as shown in FIG. 12. More specifically, the first operation mode is an operation mode in which the intake valve 11 opens/closes so as to produce a valve overlap state during a period A in FIG. 12. The period A is a period of time after the position of a piston 3 has passed a position of 90° after the bottom dead center in the exhaust stroke until the position of the piston 3 reaches a position of 90° after the top dead center in the expansion stroke without combustion.

The second operation mode is an operation mode in which an exhaust valve 12 opens/closes within the range from the compression stroke without ignition to the intake stroke. More specifically, the second operation mode is an operation mode in which the exhaust valve 12 opens/closes so as to produce a valve overlap state during a period C in FIG. 12. The period C is a period of time after the position of the piston 3 has passed a position of 90° after the bottom dead center in the compression stroke without ignition until the position of the piston 3 reaches a position of 90° after the top dead center in the intake stroke.

Based on the operation state of the six-stroke engine 1, the operation mode changing mechanism 51 switches between the above-described first operation mode, the second operation mode, and an operation mode (to be simply referred to as a third operation mode hereinafter) in which the first operation mode and the second operation mode are simultaneously implemented. The operation mode changing mechanism 51 according to this preferred embodiment switches the operation mode based on the rotation speed and the load of the engine.

The rotation speed of the engine is preferably obtained by detecting the rotation angle of a camshaft or crankshaft (not shown) by a sensor (not shown) and performing calculations. The rotation speed of the engine may also be obtained by performing calculation based on the energization interval of an ignition plug 14. The load of the engine is preferably obtained by performing calculations based on, for example, the aperture ratio of a throttle valve (not shown) provided in the intake passage. These calculations are executed by the controller 17. In addition, the switching operation of the operation mode changing mechanism 51 is controlled by the controller 17.

Figure 17:
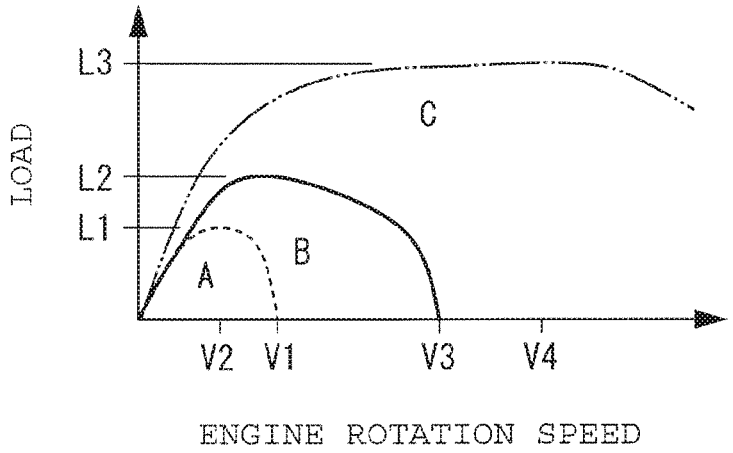
FIG. 17 is a graph showing a map used to change the operation mode.

The controller 17 controls the switching operation of the operation mode changing mechanism 51 based on a map shown in FIG. 17. The map shown in FIG. 17 allocates each type of operation mode to be switched to a rotation speed and a load. In this map, a first boundary line indicated by a broken line, a second boundary line indicated by a solid line, and a third boundary line indicated by an alternate long and two short dashed line are drawn. The first boundary line separates a region A in which the second operation mode is selected from a region B in which the above-described third operation mode is selected. The second boundary line separates the region B from a region C in which the first operation mode is selected. The third boundary line defines a rotation speed and a load as the limit of the region C in which the first operation mode is selected.

The first boundary line is drawn as a parabola passing through the origin of FIG. 17 and a first rotation speed V1. The apex of the first boundary line is located at coordinates at which the rotation speed is a second rotation speed V2 that is about ½, for example, the first rotation speed V1, and the load has a first load value L1.

The second boundary line is drawn as a parabola passing through the origin of FIG. 17 and a third rotation speed V3 higher than the first rotation speed V1. The apex of the second boundary line is located at coordinates at which the rotation speed equals the first rotation speed V1, and the load has a second load value L2.

The third boundary line indicates a rotation speed and a load at which the operation is possible, and is drawn as a parabola passing through the origin of FIG. 17. The apex of the third boundary line is located at coordinates at which the rotation speed of the engine is a fourth rotation speed V4 higher than the third rotation speed V3, and the load has a third load value L3 higher than the second load value L2. Note that the rotation speed and load to switch the operation mode are not limited to those shown in this map, and may be appropriately changed in accordance with, for example, the magnitudes of the displacement and the output of the engine.

According to the map shown in FIG. 17, when the rotation speed of the engine is the second rotation speed V2, and the load is lower than the first load value L1, the second operation mode is used. When the rotation speed of the engine is the first rotation speed V1, and the load is lower than the first load value L1, the third operation mode is used. When the rotation speed of the engine is higher than the third rotation speed V3, and the load is lower than the second load value L2, the first operation mode is used.

The operation mode changing mechanism 51 that switches the plurality of operation modes in this manner is constructed as shown in FIGS. 13 to 16. The same reference numerals as described with reference to FIGS. 1 and 3 denote the same or similar members in FIGS. 13 to 16, and a detailed description thereof will appropriately be omitted.

Figure 14:
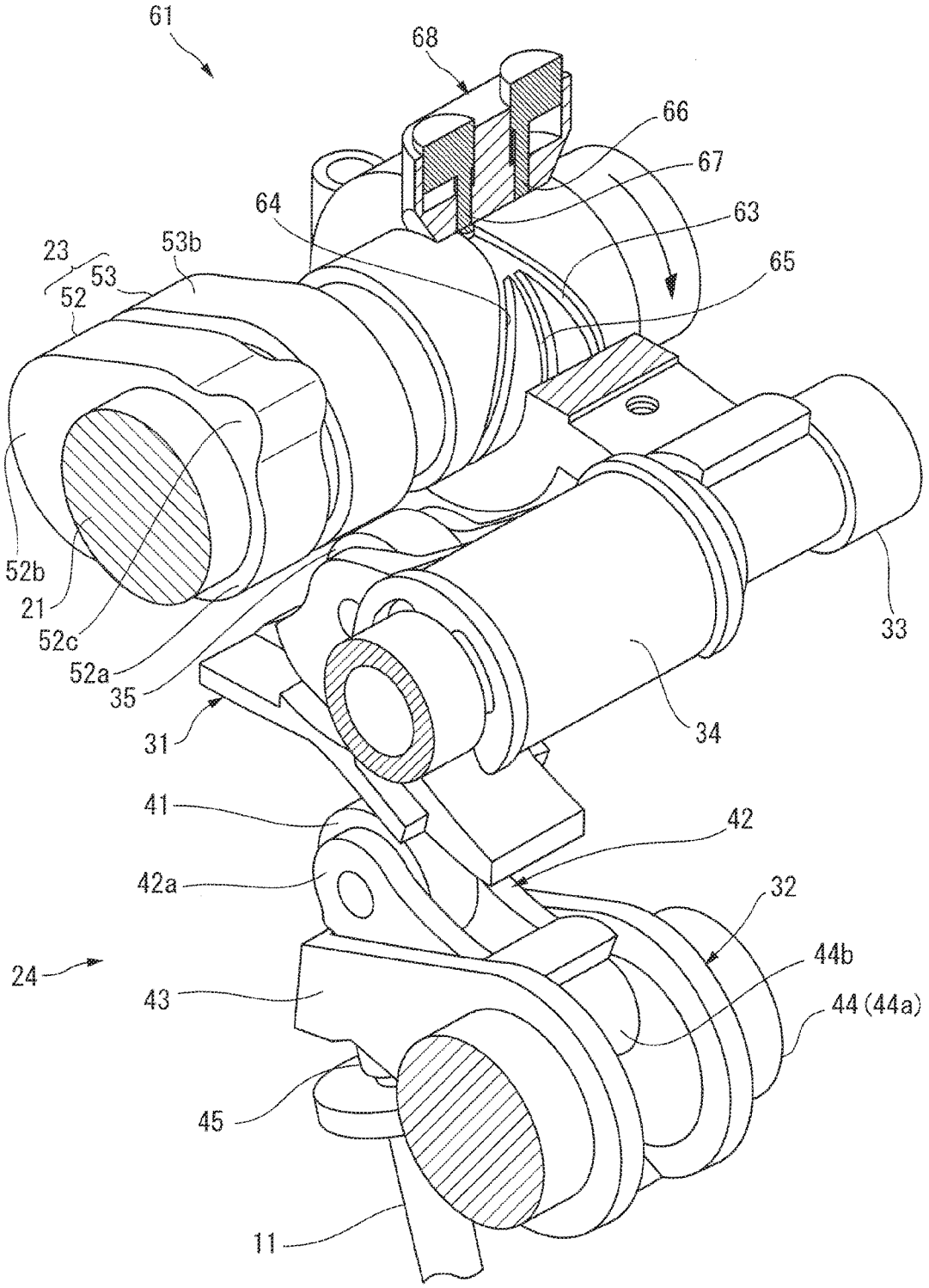
FIG. 14 is a perspective view showing the arrangement of the valve gear of the six-stroke engine according to the fourth preferred embodiment of the present invention, including a cutaway view of some components of an operation mode changing mechanism.
Figure 15A:
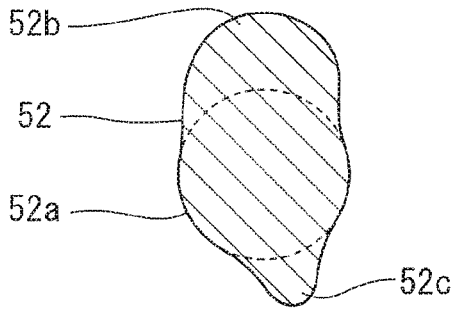
FIG. 15A is a sectional view of the first intake cam of the six-stroke engine according to the fourth preferred embodiment of the present invention.
Figure 15B:
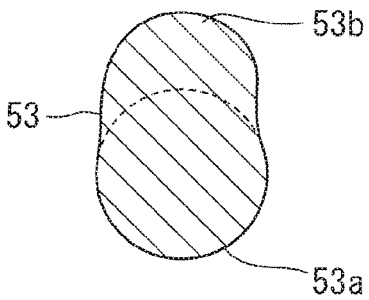
FIG. 15B is a sectional view of the second intake cam of the six-stroke engine according to the fourth preferred embodiment of the present invention.

An intake cam 23 of the valve gear 15 according to this preferred embodiment includes a first intake cam 52 and a second intake cam 53, as shown in FIGS. 14, 15A, and 15B. An exhaust cam 25 includes a first exhaust cam 54 and a second exhaust cam 55, as shown in FIGS. 16A and 16B.

The first intake cam 52 is the same as the intake cam shown in FIGS. 3 and 10, and includes a circular base portion 52*a*, a first nose portion 52*b*, and a second nose portion 52*c*, as shown in FIG. 15A.

The second intake cam 53 is equivalent to the first intake cam 52 without the second nose portion 52*c*, and includes a circular base portion 53*a* and a nose portion 53*b*, as shown in FIG. 15B. The first intake cam 52 and the second intake cam 53 are arranged in a state in which they are adjacent to each other in the axial direction of an intake camshaft 21, and the rotation phases of the first nose portion 52*b* and the nose portion 53*b* match each other.

Figure 16A:
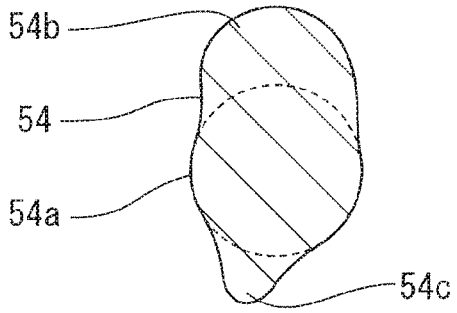
FIG. 16A is a sectional view of the first exhaust cam of the six-stroke engine according to the fourth preferred embodiment of the present invention.
Figure 16B:
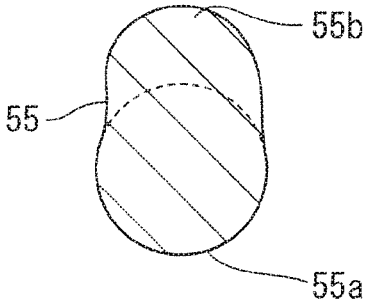
FIG. 16B is a sectional view of the second exhaust cam of the six-stroke engine according to the fourth preferred embodiment of the present invention.

The first exhaust cam 54 is the same as the exhaust cam shown in FIGS. 8 and 10, and includes a circular base portion 54*a*, a first nose portion 54*b*, and a second nose portion 54*c*, as shown in FIG. 16A.

The second exhaust cam 55 is equivalent to the first exhaust cam 54 without the second nose portion 54*c*, and includes a circular base portion 55*a* and a nose portion 55*b*, as shown in FIG. 16B. The first exhaust cam 54 and the second exhaust cam 55 are arranged in a state in which they are adjacent to each other in the axial direction of an exhaust camshaft 22, and the rotation phases of the first nose portion 54*b* and the nose portion 55*b* match each other.

Each of a swing cam 31 on the side of the intake camshaft 21 in the valve gear 15 and the swing cam 31 on the side of the exhaust camshaft 22 is supported by a support member 27 to be movable in the axial direction together with a support shaft 33. A cam surface 36 of each swing cam 31 is long in the axial direction of the camshaft. The length in the axial direction is set so as to keep a state in which the swing cam 31 contacts a rocker arm 32 even when moving in the axial direction.

Figure 13:
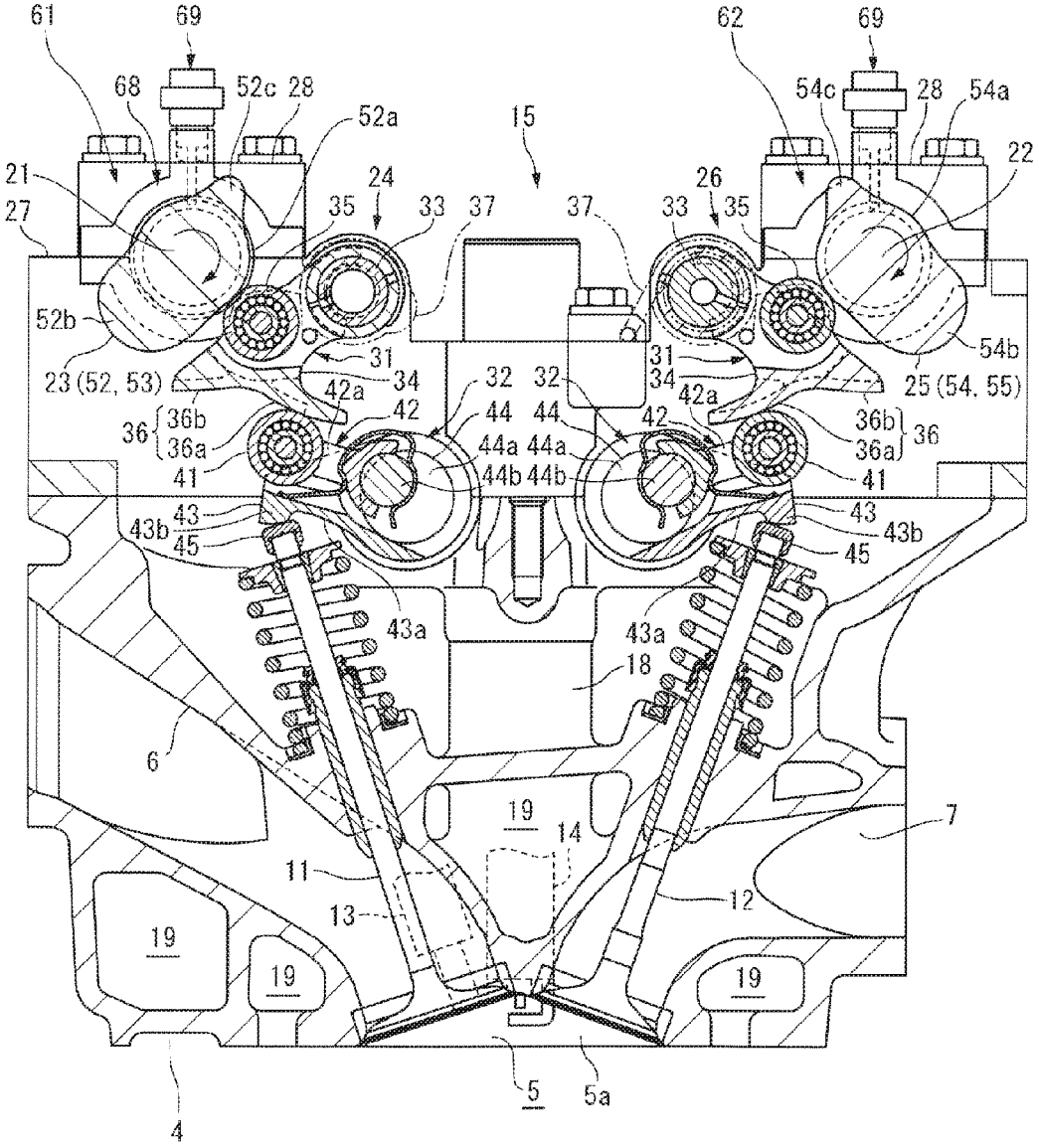
FIG. 13 is a sectional view of a cylinder head used in the six-stroke engine according to the fourth preferred embodiment of the present invention.

The operation mode changing mechanism 51 according to this preferred embodiment includes an intake-side switching unit 61 provided on the side of the intake camshaft 21, and an exhaust-side switching unit 62 provided on the side of the exhaust camshaft 22, as shown in FIG. 13. The intake-side switching unit 61 performs switching between a mode in which the first intake cam 52 drives the intake valve 11 and a mode in which the second intake cam 53 drives the intake valve 11. The exhaust-side switching unit 62 performs switching between a mode in which the first exhaust cam 54 drives the exhaust valve 12 and a mode in which the second exhaust cam 55 drives the exhaust valve 12. The intake-side switching unit 61 and the exhaust-side switching unit 62 preferably have the same structure. Hence, the intake-side switching unit 61 will be explained below. Concerning the exhaust-side switching unit 62, the same reference numerals as in the intake-side switching unit 61 are used, and a detailed description thereof will be omitted.

The intake-side switching unit 61 according to this preferred embodiment includes a structure that converts the rotation of the intake camshaft 21 into a reciprocating motion to make the swing cam 31 reciprocate. To change the rotation of the intake camshaft 21 to a reciprocating motion, as shown in FIG. 14, a first cam groove 63 and a second cam groove 64 in the intake camshaft 21, an annular groove 65 located between the cam grooves, and a slider 68 including two pins 66 and 67 to be inserted into the cam grooves 63 and 64 and the annular groove 65 are used.

The slider 68 is connected to the support shaft 33 supporting the swing cam 31 so as to move together with the support shaft 33. The two pins 66 and 67 are connected to an actuator 69 (see FIG. 13). The actuator 69 alternately inserts the two pins 66 and 67 into the cam grooves 63 and 64 and the annular groove 65 such that when one pin 66 (67) enters the cam groove 63 or 64 or the annular groove 65, the other pin 67 (66) comes out of the cam groove 63 or 64 or the annular groove 65.

The first cam groove 63 and the second cam groove 64 tilt to one side and the other side of the axial direction with respect to the rotation direction of the intake camshaft 21 so as to generate a thrust to the one side and the other side of the axial direction, and are connected to the annular groove 65 at the downstream end in the rotation direction.

In the intake-side switching unit 61, when the first pin 66 enters the annular groove 65 via the first cam groove 63, the slider 68 moves to the lower left side in FIG. 14 together with the swing cam 31, and a roller 35 comes into contact with the first intake cam 52. When the second pin 67 enters the annular groove 65 via the second cam groove 64, the slider 68 moves to the upper right side in FIG. 14 together with the swing cam 31, and the roller 35 comes into contact with the second intake cam 53.

The distance in the axial direction the slider 68 moves matches the distance the swing cam 31 moves between a position where the roller 35 of the swing cam 31 comes into contact with the first intake cam 52 and a position where the roller 35 comes into contact with the second intake cam 53. That is, when the swing cam 31 moves together with the slider 68, switching is performed between the mode to use the first intake cam 52 and the mode to use the second intake cam 53.

Switching of the intake cam 23 by the reciprocating movement of the swing cam 31 is performed when the intake valve 11 is closed, that is, when the roller 35 contacts the circular base portions 52*a* and 53*a*, as shown in FIG. 12. Note that switching of the exhaust cam 25 is performed when the exhaust valve 12 is closed (when the roller 35 contacts the circular base portions 54*a* and 55*a*).

The above-described first operation mode is implemented by using the first intake cam 52 and the second exhaust cam 55.

The second operation mode is implemented by using the second intake cam 53 and the first exhaust cam 54.

The third operation mode is implemented by using the first intake cam 52 and the first exhaust cam 54.

The valve gear 15 according to this preferred embodiment uses at least one of the first operation mode and the second operation mode based on the rotation speed and load of the engine.

Hence, according to this preferred embodiment, since the valve overlap state is produced at a time appropriate for the operation state of the engine, it is possible to provide a six-stroke engine that more efficiently performs gas exchange in the cylinder 2, and a method of operating the six-stroke engine.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A six-stroke engine comprising:

a cylinder;

a piston inserted into the cylinder and that reciprocates between a bottom dead center and a top dead center;

a cylinder head attached to the cylinder;

a combustion chamber defined by the cylinder, the piston, and the cylinder head;

an intake port in the cylinder head and including a downstream end open to the combustion chamber;

an exhaust port in the cylinder head and including an upstream end open to the combustion chamber;

an intake valve provided in the cylinder head and that opens/closes the intake port;

an exhaust valve provided in the cylinder head and that opens/closes the exhaust port;

a fuel injector that injects fuel into at least one of the combustion chamber and the intake port;

an ignition plug attached to a wall of the combustion chamber; and a valve gear that operates the intake valve and the exhaust valve to execute six strokes including an intake stroke, a compression stroke with ignition, an expansion stroke with combustion, an exhaust stroke, an expansion stroke without combustion, and a compression stroke without ignition, in this order; wherein within a period from the exhaust stroke to the intake stroke, the valve gear opens at least one of the intake valve that was closed in the exhaust stroke and the exhaust valve that was closed in the intake stroke only for a predetermined period of time, which includes a period when the piston is located on a side of the top dead center during a period from the exhaust stroke to the intake stroke, and then closes the at least one of the intake valve and the exhaust valve to produce a valve overlap state in which both the intake valve and the exhaust valve are open;

the valve overlap state is produced at least once within the period from the exhaust stroke to the intake stroke, and the intake valve is closed during the exhaust stroke except for the predetermined period of time.

2. The six-stroke engine according to claim 1, wherein the valve gear opens and closes the intake valve so as to produce the valve overlap state within a period of time after a position of the piston has passed a position of 90° after the bottom dead center in the exhaust stroke until the position of the piston reaches a position of 90° after the top dead center in the expansion stroke without combustion.

3. The six-stroke engine according to claim 1, wherein the valve gear opens and closes the exhaust valve so as to produce the valve overlap state within a period of time after a position of the piston has passed a position of 90° after the bottom dead center in the compression stroke without ignition until the position of the piston reaches a position of 90° after the top dead center in the intake stroke.

4. The six-stroke engine according to claim 1, wherein the valve gear opens and closes the intake valve so as to produce the valve overlap state within a period of time after a position of the piston has passed a position of 90° after the bottom dead center in the exhaust stroke until the position of the piston reaches a position of 90° after the top dead center in the expansion stroke without combustion, and opens and closes the exhaust valve so as to produce the valve overlap state within a period of time after the position of the piston has passed the position of 90° after the bottom dead center in the compression stroke without ignition until the position of the piston reaches the position of 90° after the top dead center in the intake stroke.

5. The six-stroke engine according to claim 1, wherein, based on a rotation speed and a load of the engine, the valve gear operates in at least one of:

a first operation mode in which the intake valve is opened and closed so as to produce the valve overlap state within a period of time after a position of the piston has passed a position of 90° after the bottom dead center in the exhaust stroke until the position of the piston reaches a position of 90° after the top dead center in the expansion stroke without combustion; and a second operation mode in which the exhaust valve is opened and closed so as to produce the valve overlap state within a period of time after the position of the piston has passed the position of 90° after the bottom dead center in the compression stroke without ignition until the position of the piston reaches the position of 90° after the top dead center in the intake stroke.

6. A method of operating a six-stroke engine including a cylinder; —a piston inserted into the cylinder and that reciprocates between a bottom dead center and a top dead center; a cylinder head attached to the cylinder; a combustion chamber defined by the cylinder, the piston, and the cylinder head; an intake port in the cylinder head and including a downstream end open to the combustion chamber; an exhaust port in the cylinder head and including an upstream end open to the combustion chamber; an intake valve in the cylinder head and that opens/closes the intake port; an exhaust valve in the cylinder head and that opens/closes the exhaust port; a fuel injector that injects fuel into at least one of the combustion chamber and the intake port; and an ignition plug attached to a wall of the combustion chamber; the method comprising the steps of:

executing, for the engine, six strokes including an intake stroke, a compression stroke with ignition, an expansion stroke with combustion, an exhaust stroke, an expansion stroke without combustion, and a compression stroke without ignition, in this order; and opening at least one of the intake valve that was closed in the exhaust stroke and the exhaust valve that was closed in the intake stroke only for a predetermined period of time, which includes a period when the piston is located on a side of the top dead center during a period from the exhaust stroke to the intake stroke, and then closing the at least one of the intake valve and the exhaust valve to produce a valve overlap state in which both the intake valve and the exhaust valve are open at least once during the period from the exhaust stroke to the intake stroke, the intake valve being closed during the exhaust stroke except for the predetermined period of time.

7. The method of operating a six-stroke engine according to claim 6, wherein the valve overlap state is produced by opening and closing the intake valve within a period of time after a position of the piston has passed a position of 90° after the bottom dead center in the exhaust stroke until the position of the piston reaches a position of 90° after the top dead center in the expansion stroke without combustion.

8. The method of operating a six-stroke engine according to claim 6, wherein the valve overlap state is produced by opening and closing the exhaust valve within a period of time after a position of the piston has passed a position of 90° after the bottom dead center in the compression stroke without ignition until the position of the piston reaches a position of 90° after the top dead center in the intake stroke.

9. The method of operating a six-stroke engine according to claim 6, wherein the valve overlap state is produced:

by opening and closing the intake valve within a period of time after a position of the piston has passed a position of 90° after the bottom dead center in the exhaust stroke until the position of the piston reaches a position of 90° after the top dead center in the expansion stroke without combustion; and by opening and closing the exhaust valve within a period of time after the position of the piston has passed the position of 90° after the bottom dead center in the compression stroke without ignition until the position of the piston reaches the position of 90° after the top dead center in the intake stroke.

10. The method of operating a six-stroke engine according to claim 6, further comprising the step of operating a valve gear in at least one of:

a first operation mode in which the valve overlap state is produced by opening and closing the intake valve within a period of time after a position of the piston has passed a position of 90° after the bottom dead center in the exhaust stroke until the position of the piston reaches a position of 90° after the top dead center in the expansion stroke without combustion; and a second operation mode in which the valve overlap state is produced by opening and closing the exhaust valve within a period of time after the position of the piston has passed the position of 90° after the bottom dead center in the compression stroke without ignition until the position of the piston reaches the position of 90° after the top dead center in the intake stroke is selected based on a rotation speed and a load of the engine.

* * * * *